US009884697B2

(12) United States Patent
Hirose

(10) Patent No.: US 9,884,697 B2
(45) Date of Patent: Feb. 6, 2018

(54) PRINTER

(71) Applicant: SATO HOLDINGS KABUSHIKI KAISHA, Tokyo (JP)

(72) Inventor: Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/510,861

(22) PCT Filed: Apr. 8, 2015

(86) PCT No.: PCT/JP2015/060950
§ 371 (c)(1),
(2) Date: Mar. 13, 2017

(87) PCT Pub. No.: WO2016/072106
PCT Pub. Date: May 12, 2016

(65) Prior Publication Data

US 2017/0275042 A1 Sep. 28, 2017

(30) Foreign Application Priority Data

Nov. 4, 2014 (JP) ..... 2014-224373

(51) Int. Cl.
*B65C 9/00* (2006.01)
*B65C 9/18* (2006.01)
(Continued)

(52) U.S. Cl.
CPC ..... *B65C 9/1811* (2013.01); *B65C 9/183* (2013.01); *B65H 26/06* (2013.01); *B65C 9/32* (2013.01);
(Continued)

(58) Field of Classification Search
CPC ..... B41J 3/36; B41J 15/04; B41J 29/00; B41J 29/13; B41J 2/32; B41J 3/4075;
(Continued)

(56) References Cited

U.S. PATENT DOCUMENTS 8,702,329 B2 * 4/2014 Takabatake ..... B41J 3/4075 400/611
2010/0247217 A1 9/2010 Tsugaru et al.
(Continued)

FOREIGN PATENT DOCUMENTS

JP 9-244319 A 9/1997
JP 2008-062632 A 3/2008
(Continued)

*Primary Examiner* — David Banh
(74) *Attorney, Agent, or Firm* — Foley & Lardner LLP

(57) ABSTRACT

A printer for label printing includes a cutter to cut a continuous label after printing at a position inside of the surface with respect to the outer case of the printer. A separation sensor is disposed between the cutter and the thermal head. A sheet detection sensor is disposed downstream of the cutter in the feeding direction. The sensors are mounted in two stages on a common circuit board. The circuit board is disposed vertically along the feeding direction of the continuous label within the region where a cover-open button to open an opening and closing cover of the printer is disposed.

18 Claims, 14 Drawing Sheets

(51) Int. Cl.
*B65H 26/06* (2006.01)
*B65C 9/32* (2006.01)

(52) U.S. Cl.
CPC .. *B65C 2009/1834* (2013.01); *B65H 2553/51* (2013.01)

(58) Field of Classification Search
CPC ..... B65C 9/18; B65C 9/183; B65C 9/181; B65C 9/32; B65C 2009/1834; B65H 26/06; B65H 2553/51
See application file for complete search history.

(56) References Cited

U.S. PATENT DOCUMENTS

| | | | | |
|---|---|---|---|---|
| 2017/0021649 | A1* | 1/2017 | Hirose | B41J 3/36 |
| 2017/0036462 | A1* | 2/2017 | Katayama | B41J 3/36 |
| 2017/0036469 | A1* | 2/2017 | Katayama | B41J 2/32 |

FOREIGN PATENT DOCUMENTS

| | | | |
|---|---|---|---|
| JP | 2010-234560 | A | 10/2010 |
| JP | 2014-4708 | A | 1/2014 |
| JP | 2014-12349 | A | 1/2014 |
| JP | 2014-104688 | A | 6/2014 |

* cited by examiner

PRINTER

TECHNICAL FIELD

The present invention relates to a printer, for example, a printer configured to print desired information, such as letters, symbols, graphics, or barcodes on a continuous label.

BACKGROUND ART

A printer for label printing includes a thermal head and a platen roller. The printer pinches one end of a continuous label wound into a roll between the thermal head and the platen roller, and feeds the continuous label by rotating the platen roller, for example. During this feeding, the printer prints desired information on labels.

Laid open patent publication JP 2008-62632 A, for example, describes such a label printer. This label printer includes a platen roller disposed rotatably at the opening end of an opening and closing cover configured to open and close a container of a continuous label. A thermal head is disposed at an internal position of the label printer so as to be opposed to the platen roller when the opening and closing cover is closed.

SUMMARY OF THE INVENTION

Technical Problem

Mobility and ease of use have been requested for label printers. For instance, label printers in demand do not take up space, fit in hands, are easy to carry, and enable ejection of labels while carrying the printer. One issue for label printers, therefore, is how to reduce the size of printers.

In view of the technical background as described above, the present invention aims to provide a technique of reducing the size of a printer.

Solution to Problem

A printer according to a first aspect of the present invention comprises: a housing that stores a print medium; an opening and closing cover that can be opened and closed relative to the housing; a feed roller disposed at the opening and closing cover, the feed roller being configured to feed the print medium; a print head disposed to be opposed to the feed roller in the housing, the print head being configured to print on the print medium; a cutting unit disposed to be opposed to the feed roller, the cutting unit being disposed downstream of the feed roller in a feeding direction, the cutting unit being configured to cut the print medium after printing by the print head; a first detector disposed between the print head and the cutting unit, the first detector being configured to detect the print medium after printing; a second detector disposed downstream of the cutting unit in the feeding direction, the second detector being configured to detect the print medium after printing; and a circuit board common to the first detector and the second detector, the circuit board being configured to mount both of the first detector and the second detector.

The printer according to a second aspect of the present invention may further comprise a separation unit disposed movably between a first position and a second position, the separation unit being opposed to the first detector at the first position between the print head and the cutting unit, the separation unit being closer to the feed roller at the second position than at the first position, wherein when a label with a liner including a label temporarily adhering to the liner is used as the print medium, the separation unit is placed at the second position to separate the label after printing from the liner.

In the printer according to a third aspect of the present invention, when a label with a liner including a label temporarily adhering to the liner is used as the print medium, the first detector may detect the label after printing and separated from the liner, and when the label with a liner or a linerless label without the liner is used as the print medium, the second detector may detect the print medium after printing.

The printer according to a fourth aspect of the present invention may further comprise: a head holding member disposed swingably in the housing to hold the opening and closing cover and cancel the holding of the opening and closing cover, the head holding member being configured to hold the print head; and a cancelling member configured to apply a pressing force to the head holding member to cancel the holding of the opening and closing cover, wherein the circuit board may be disposed vertically along the feeding direction in a range of a region where the cancelling member is disposed so that the first detector and the second detector face a feed path of the print medium and are disposed side by side along the feeding direction.

In the printer according to a fifth aspect of the present invention, the head holding member may include: a holding part to hold the print head; and a pair of pressed parts extending from the holding part in a direction away from the feed roller, the pressed parts sandwiching both lateral faces of the circuit board in a direction of the width of the circuit board intersecting with the feeding direction, the pair of pressed parts receiving a pressing force from the cancelling member when the holding of the opening and closing cover is cancelled, wherein the cancelling member may include: a pressing part opposed to one lateral face of the circuit board vertically disposed; and a pair of legs extending from the pressing part to come in contact with the pair of pressed parts of the head holding member, the pair of legs sandwiching both lateral faces of the circuit board in the direction of the width of the circuit board.

In the printer according to a sixth aspect of the present invention, the pressing part of the cancelling member may have a concave depressed in a direction away from the circuit board at a part of the pressing part opposed to the circuit board.

In the printer according to a seventh aspect of the present invention, the circuit board may be disposed at a blank area surrounded with the pressing part and the pair of legs of the cancelling member.

The printer according to an eighth aspect of the present invention may further comprise a protrusion between the first detector and the print head, the protrusion protruding from a position closer to the first detector toward the feed roller.

Advantageous Effects

According to the present invention, the first detector and the second detector are mounted on a common circuit board. With this configuration, the printer can be compact as compared with the configuration including different circuit boards on which the first detector and the second detector are mounted.

DESCRIPTION OF EMBODIMENTS

Figure 1A:
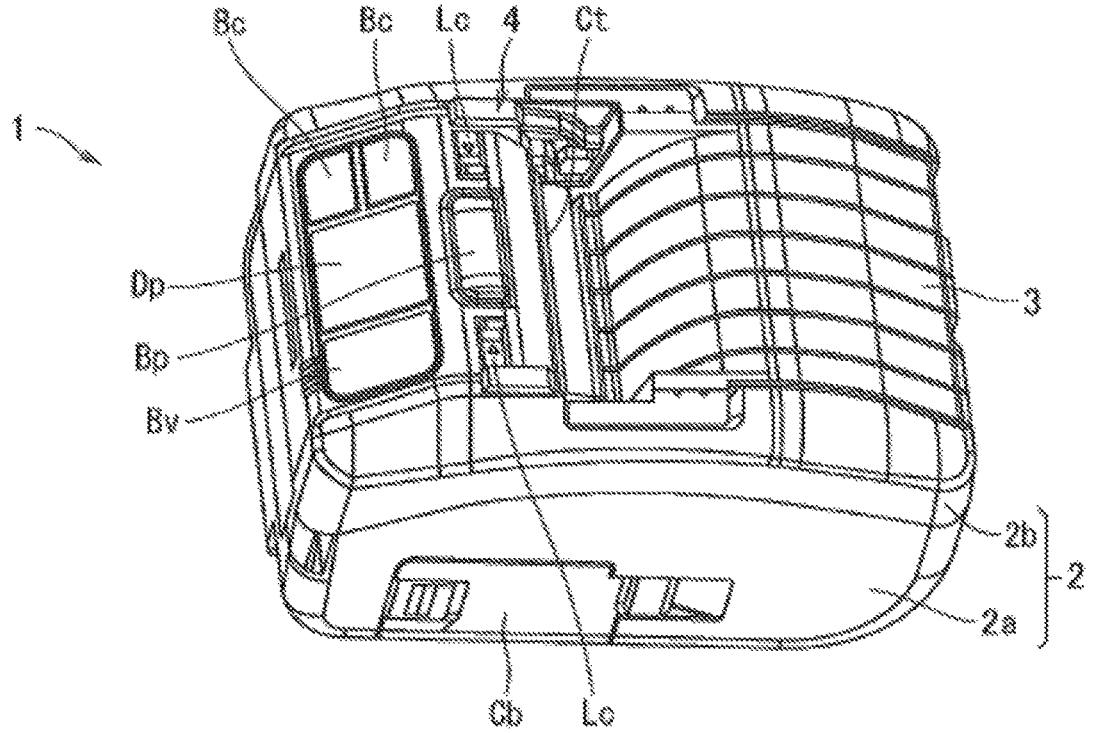
FIG. 1A is an overall perspective view of a printer according to one embodiment of the present invention in the normal ejection state.

The present invention relates to Japanese Patent Application No. 2014-224373 filed on Nov. 4, 2014, the contents of which are incorporated herein by reference.

The following describes one embodiment, but not limited to, of the present invention in details, with reference to the drawings. In the drawings describing the embodiment, like numbers indicate like components to omit their overlapped descriptions. The terms used for the embodiment are briefly described as follows. Feeding is an operation to convey a continuous label (one example of a print medium) for printing. A feeding direction (one example of a feeding direction for printing) is a direction to convey a continuous label for printing. Specifically, this refers to the direction of sending a continuous label from a sheet feeder to a thermal head. Back feeding is an operation following the printing of desired information on a desired label of the continuous label. The back feeding sends the continuous label in the reverse direction of the feeding direction and returns subsequent another label to a print start position. A back feeding direction is a direction to convey the continuous label for back feeding. Specifically, this refers to the direction of sending the continuous label from the thermal head to the sheet feeder. Printing is performed on labels in the continuous form (one example of a label with a liner) as a continuous label, and the continuous label includes a plurality of labels with predetermined intervals that temporarily adhere to a long belt-shaped liner. Separation ejection is a mode of separating the labels one by one from the liner and ejecting the separated labels from the printer. Normal ejection is a mode of ejecting the labels from the printer without separating them from the liner. The normal ejection includes continuous ejection and linerless label ejection. When labels with a liner are used, the printer operates in the continuous ejection mode in which the printer ejects the labels continuously without separating them from the liner. When a label without a liner in the continuous form (one example of a linerless label) is used, the printer feeds the label while exposing an adhesive layer of the label on one side. In this case, the printer operates in the linerless label ejection mode in which the printer ejects the labels one by one.

Figure 1B:
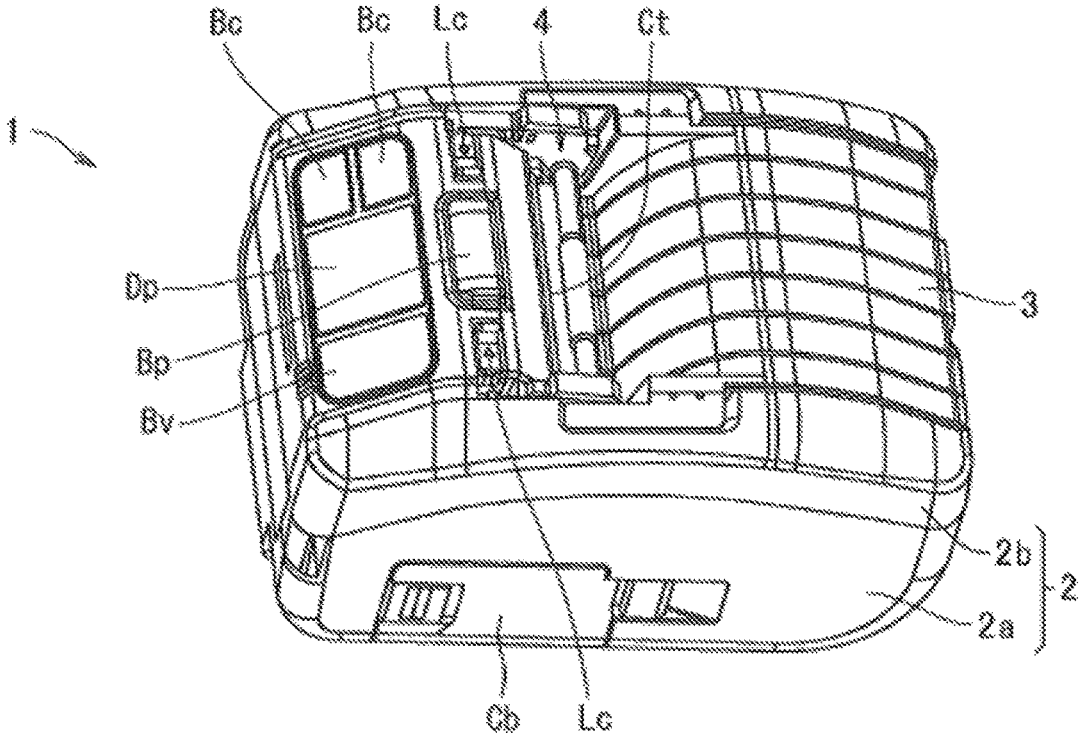
FIG. 1B is an overall perspective view of the printer of FIG. 1A in the separation ejection state.
Figure 2:
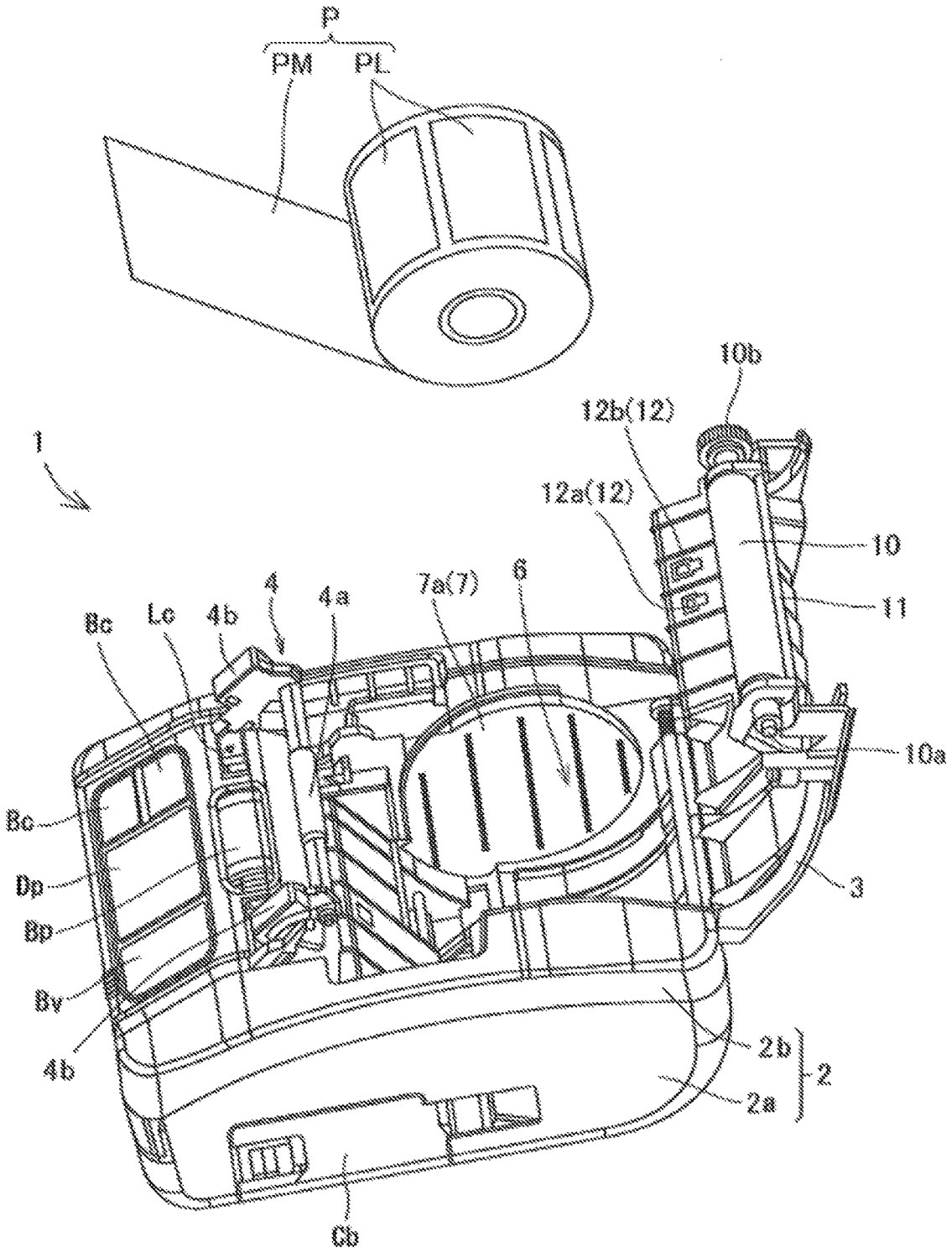
FIG. 2 is an overall perspective view showing the appearance of the printer of FIGS. 1A and 1B when the opening and closing cover is open, and the continuous label.

FIG. 1A is an overall perspective view of a printer according to the present embodiment in the normal ejection state. FIG. 1B is an overall perspective view of the printer of FIG. 1A in the separation ejection state. FIG. 2 is an overall perspective view showing the appearance of the printer of FIGS. 1A and 1B when the opening and closing cover is open, and the continuous label.

As shown in FIGS. 1A and 1B, the printer 1 of the present embodiment is a portable label printer that has a flat cuboid shape, for example. The printer 1 is a double-function type that can select the separation ejection or the normal ejection. The printer 1 can be used with its ejection port directed upward (transverse use). The printer 1 can also be used with a belt hook (not illustrated) on an outer face of the printer 1 hanging from a belt of the operator, or can also be used with a shoulder belt (not illustrated) hanged on the shoulder of the operator so as to place the ejection port laterally (vertical use).

As shown in FIG. 2, a continuous label P (label with a liner) is used as the print medium of the printer 1, for example. The continuous label includes a long belt-shaped liner PM and a plurality of labels PL temporarily adhering to the liner along the longitudinal direction with predetermined intervals. The label attaching face of the liner PM is coated with a parting agent, such as silicone, so as to be easily separate the labels PL therefrom. On the rear face of the label attaching face of the liner PM, position detection marks (not illustrated) are formed with predetermined intervals along the longitudinal direction. The position detection marks indicate the positions of the labels. On the surface (print surface) of each label, a thermo-sensitive color-producing layer is formed. This layer develops a specific color (e.g., black or red) when the temperature of the layer reaches a predetermined temperature region.

The print medium is not limited to a label with a liner, and various types of labels can be used. For instance, the print medium may be a linerless label which the printer feeds while exposing the adhesive layer. In this case, the linerless label has position detection marks (not illustrated) on the side of the adhesive layer, indicating the positions of the labels. The position detection marks are formed with predetermined intervals along the longitudinal direction. On the surface (the rear face of the adhesive layer, a print surface)

of the linerless label, a thermo-sensitive color-producing layer as described above is formed. Other media may be used. They include a continuous sheet (linerless label) without a liner and an adhesive layer, and a printable film (such as journal sheet) that can be printed with the thermal head instead of paper. Such a continuous sheet and film also can have position detection marks.

The printer 1 includes an outer case 2, an opening and closing cover 3, a separation unit 4, a sheet container (print medium container) 6 (see FIG. 2), and a sheet guide unit 7 (see FIG. 2).

The outer case 2 is a housing that defines a part of the outer shape of the printer 1. The outer case includes a body part 2*a* and a front cover 2*b*. The body part 2*a* is a box-shaped member made of plastic, and has an opening at one face thereof, for example. A battery cover Cb is pivotally supported on one lateral face of the body part 2*a* so as to open and close. The front cover 2*b* is a rid-like member made of plastic, and is configured to cover the opening of the body part 2*a* partially, for example. The front cover 2*b* is screwed to the body part 2*a*. A display Dp, operation buttons Bc, a power-supply button By, a cover-open button (one example of a releasing unit) Bp, a pair of cancel levers Lc, Lc and a cutter Ct are disposed on the surface of the front cover 2*b*. The display Dp is a liquid crystal display (LCD), for example, configured to display operation commands, messages and the like. The operation buttons Bc are configured to manipulate the printer 1 about their operations and settings. The power-supply button By is configured to turn the power supply of the printer 1 on or off. The printer has an ejection port for the continuous label P after printing. The ejection port lies between the front cover 2*b* and the opening and closing cover 3. For the printer 1, the face having the battery cover Cb and its counter face are called the lateral faces of the printer 1.

The opening and closing cover 3 is an opening and closing cover of the sheet container 6. The other end in the longitudinal direction of the opening and closing cover 3 is pivotally supported at an opening and closing supporting shaft 3*a* (see FIGS. 3A and 3B, for example) such that one end in the longitudinal direction (opening end, located closer to the center of the outer case 2 in the longitudinal direction) of the opening and closing cover 3 can move away from and closer to the outer case 2. The opening and closing cover 3 is biased to the opening direction (the direction to which the opening end of the opening and closing cover 3 moves away from the outer case 2) with a torsional spring 3*b*(see FIGS. 3A and 3B, for example). The torsional spring 3*b* is disposed at the opening and closing supporting shaft 3*a* at the other end of the opening and closing cover 3 in the longitudinal direction.

As shown in FIG. 2, a platen roller (feed roller) 10 is pivotally supported at the opening end of the opening and closing cover 3 so that the roller can rotate in the forward direction and the reverse direction. This platen roller 10 is feed means configured to feed a continuous label P. The platen roller 10 extends in the width direction (the direction of a shorter side) of the continuous label P. The platen roller 10 is made of silicone-containing resin or silicone rubber, for example. A gear 10*b* is connected to one end of the platen shaft 10*a* of the platen roller 10. This gear 10*b* engages with a gear unit (not illustrated) when the opening and closing cover 3 is closed, so that the gear is mechanically connected to a driving motor (not illustrated) via the gear unit. The gear unit includes a plurality of gears that mutually engages with each other. The driving motor includes a stepping motor, for example.

A separation pin 11 is disposed in the vicinity of the platen roller 10. The separation pin 11 extends along the platen roller 10 at the opening end of the opening and closing cover 3. This separation pin 11 is a separation member to separate the labels PL from the liner PM when a label with a liner is used as the continuous label P. Both ends in the longitudinal direction of the separation pin 11 are pivotally supported at the opening and closing cover 3.

Sensors 12 (12*a*, 12*b*) are disposed at the opening end of the opening and closing cover 3 on the face opposed to the continuous label P. The sensor 12*a* is configured to detect the presence or absence of the continuous label P. The sensor 12*a* includes a thru-beam optical sensor, for example. The sensor 12*b* is configured to detect the position of the labels PL (the position detection marks of the liner PM). The sensor 12*b* includes a reflective optical sensor, for example.

The separation unit 4 is configured to feed the liner PM and the labels PL into different paths to separate the labels PL of the continuous label P from the liner PM in the separation ejection mode. At the leading end of the separation unit 4, a nip roller 4*a* is rotatably pinched between a pair of supporting parts 4*b*, 4*b*. The separation unit 4 is described later.

As shown in FIG. 2, the sheet container 6 is a space to contain a roll-shaped continuous label P. Inside of the sheet container 6, a pair of guide plates 7*a* of the sheet guide unit 7 is disposed. The sheet guide unit 7 is a mechanical unit to support the continuous label P for guiding, depending on the width of the continuous label. The guide plates 7*a* are members to rotatably support a roll-shaped continuous label P while coming into contact with both end faces of the roll-shaped continuous label P in the width direction, so as to guide the feeding of the continuous label P. The guide plates 7*a* are movable along the width direction of the continuous label P so that their positions can be changed depending on the width of the continuous label P.

Figure 3A:
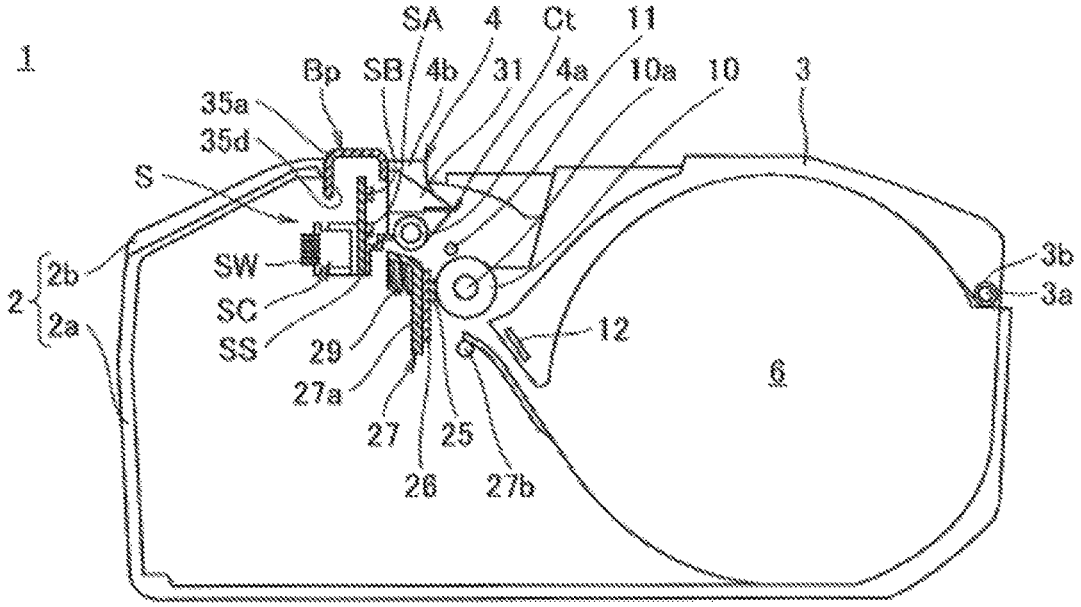
FIG. 3A is a schematic cross-sectional view of the printer of FIG. 1A in the normal ejection state at a center in the width direction of the printer.
Figure 3B:
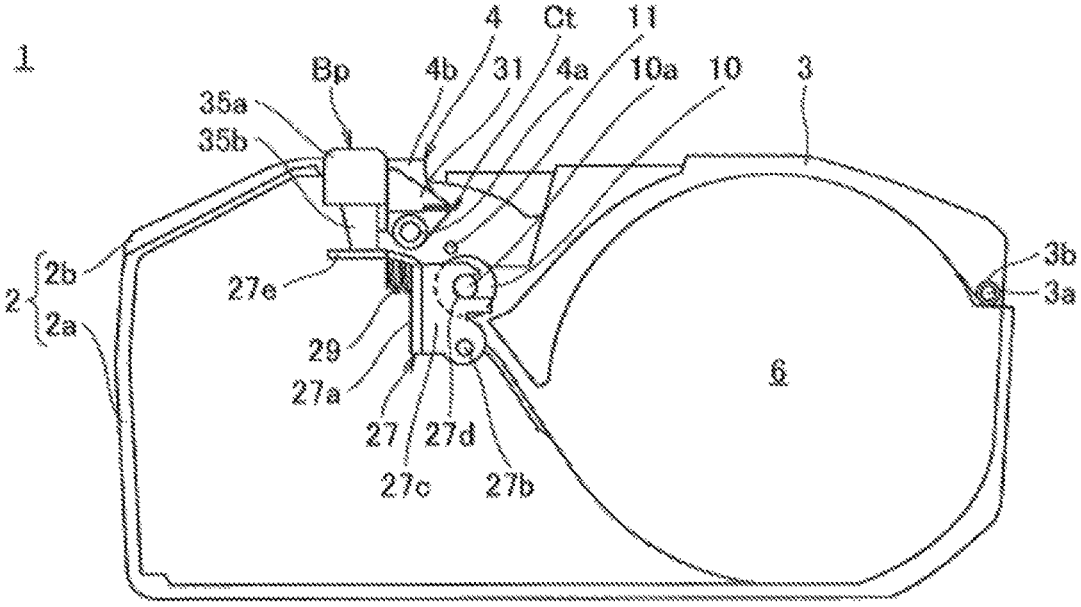
FIG. 3B is a schematic cross-sectional view of the printer of FIG. 1A in the normal ejection state at one end in the width direction of the printer.
Figure 4A:
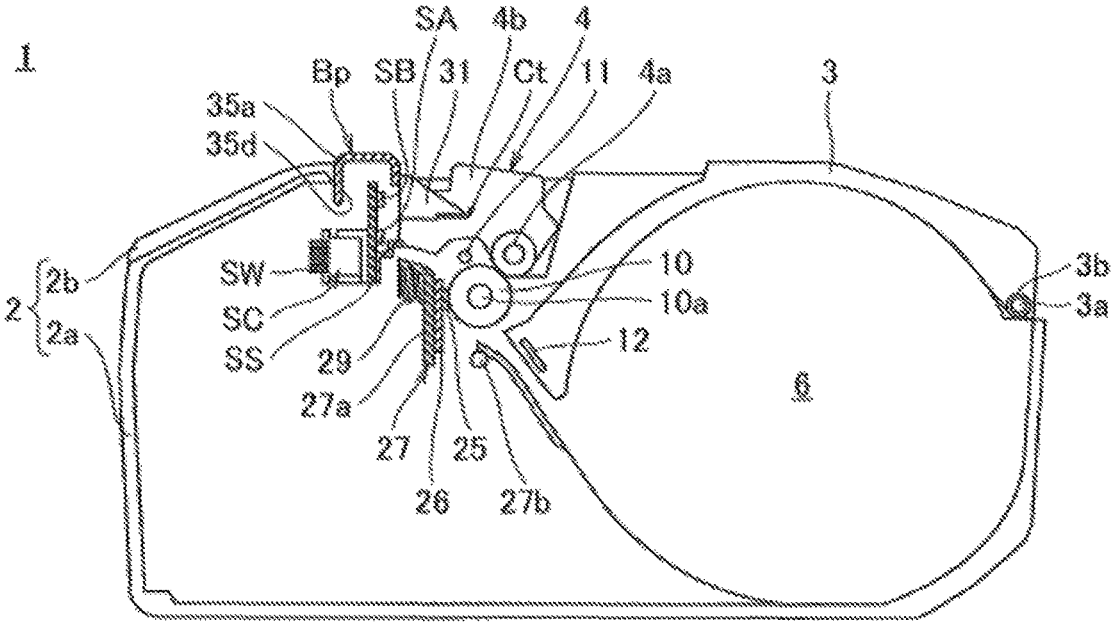
FIG. 4A is a schematic cross-sectional view of the printer of FIG. 1B in the separation ejection state at a center in the width direction of the printer.
Figure 4B:
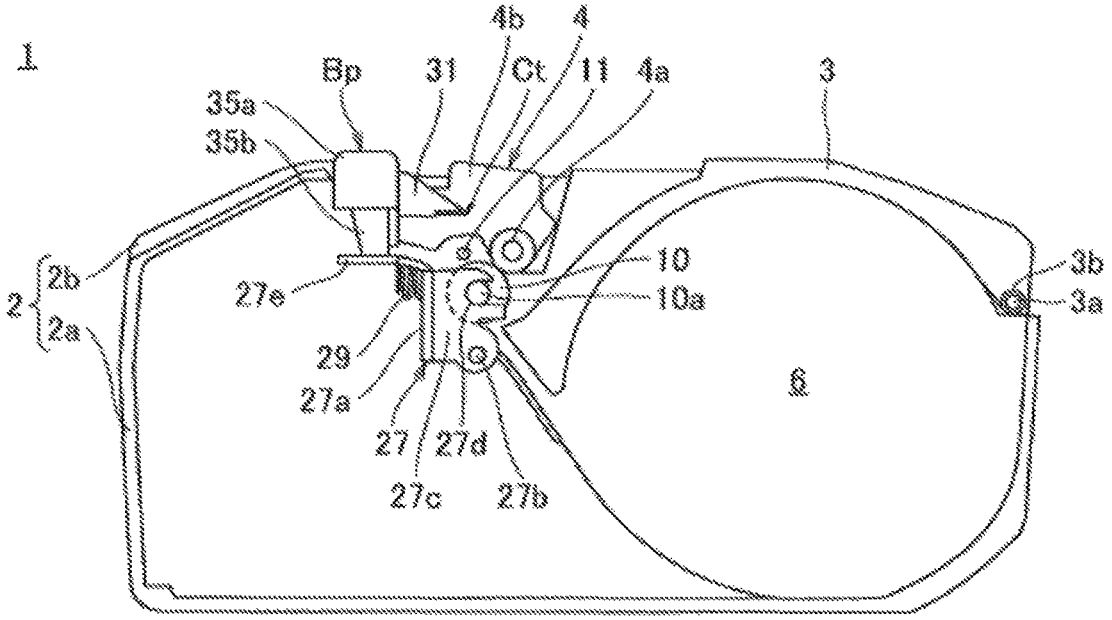
FIG. 4B is a schematic cross-sectional view of the printer of FIG. 1B in the separation ejection state at one end in the width direction of the printer.
Figure 5:
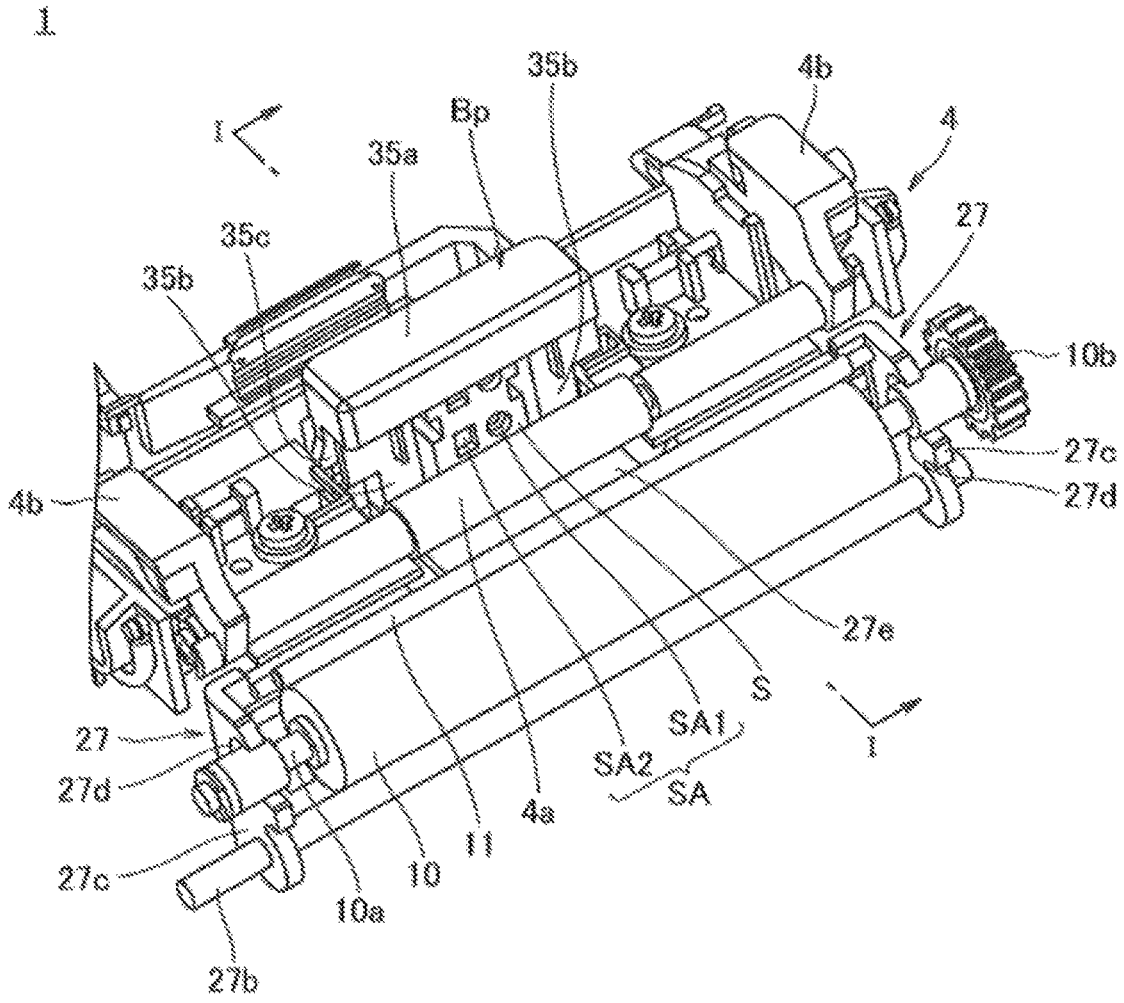
FIG. 5 is a perspective view of a major part of the printer of FIG. 1A and FIG. 1B.
Figure 6:
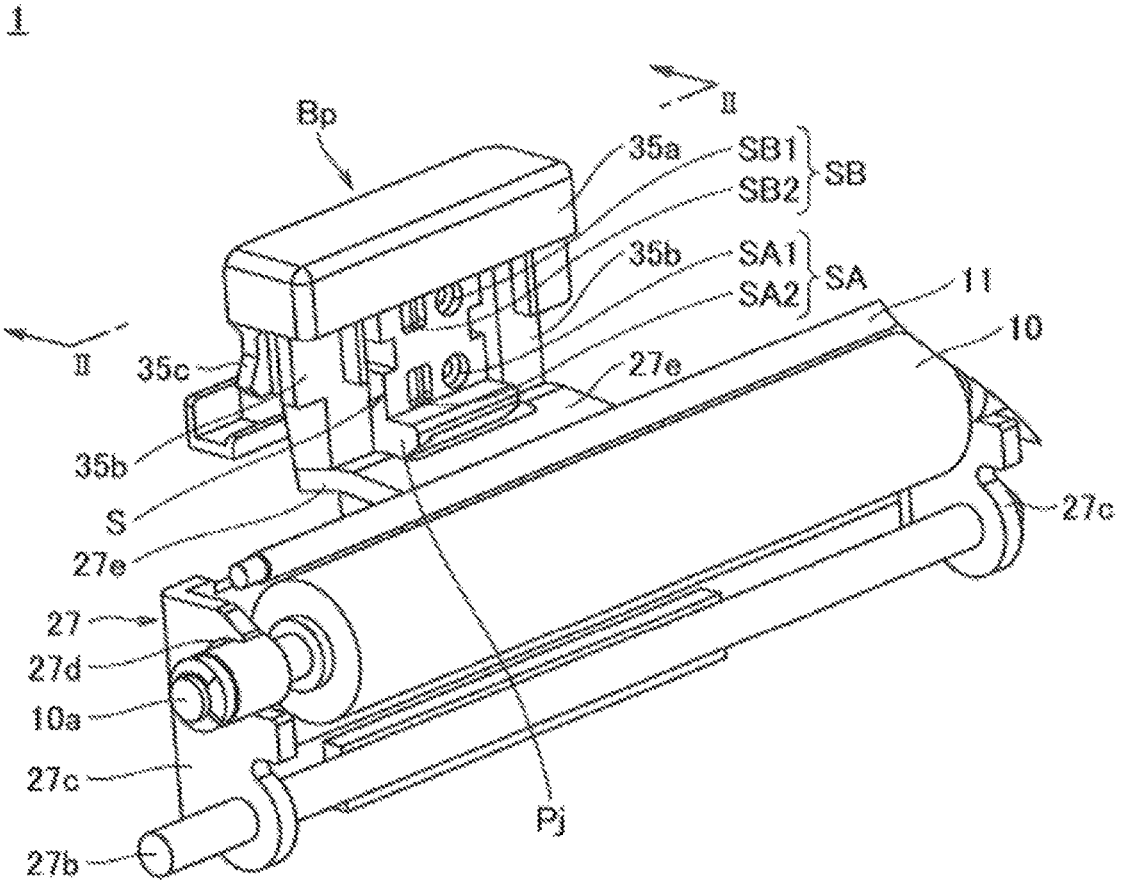
FIG. 6 is a perspective view of a major part of the printer of FIG. 5 when a part of the printer including a separation unit is detached.
Figure 7A:
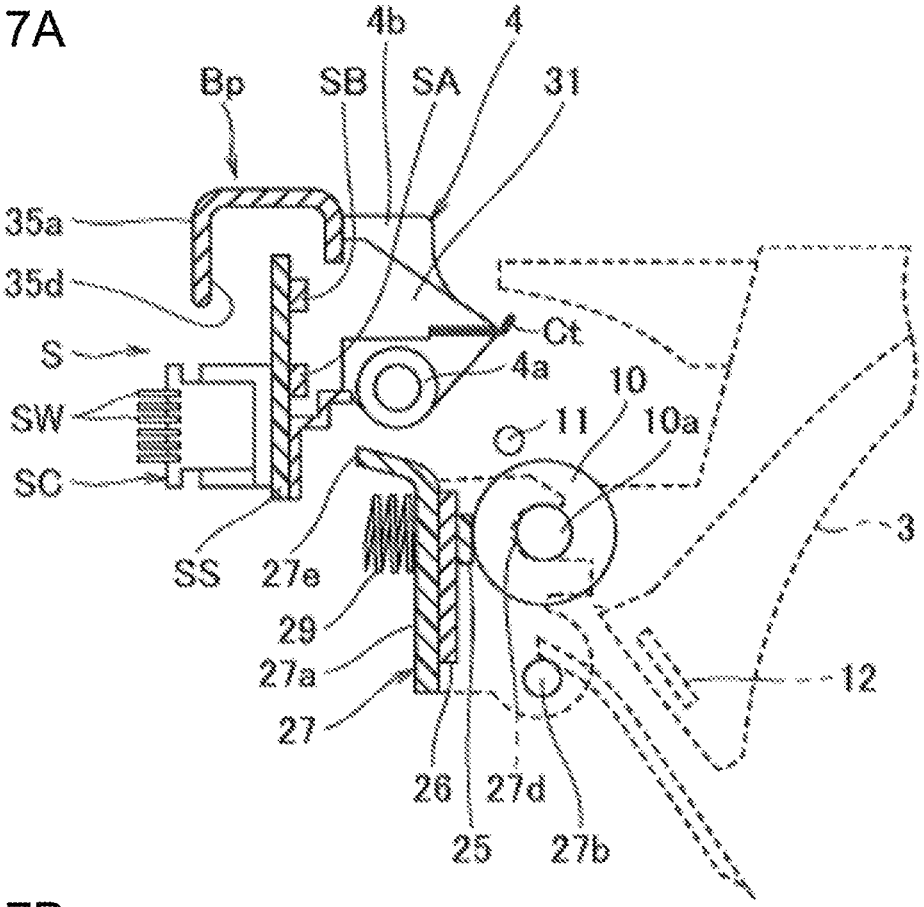
FIG. 7A is a cross-sectional view taken along the line I-I of FIG. 5.
Figure 7B:
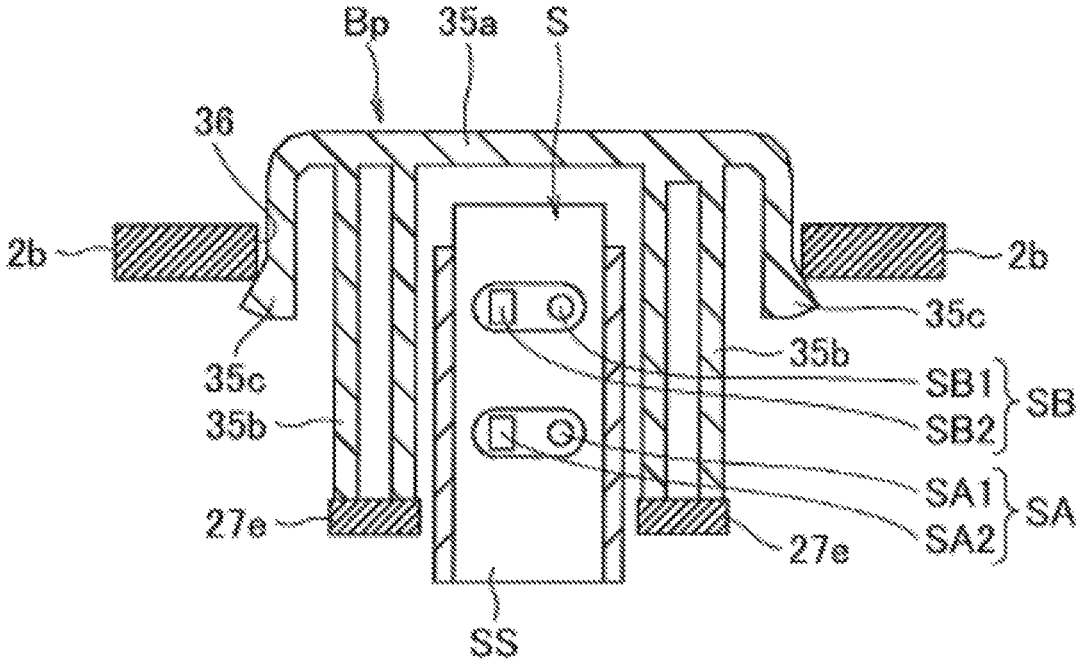
FIG. 7B is a cross-sectional view taken along the line II-II of FIG. 6.
Figure 8A:
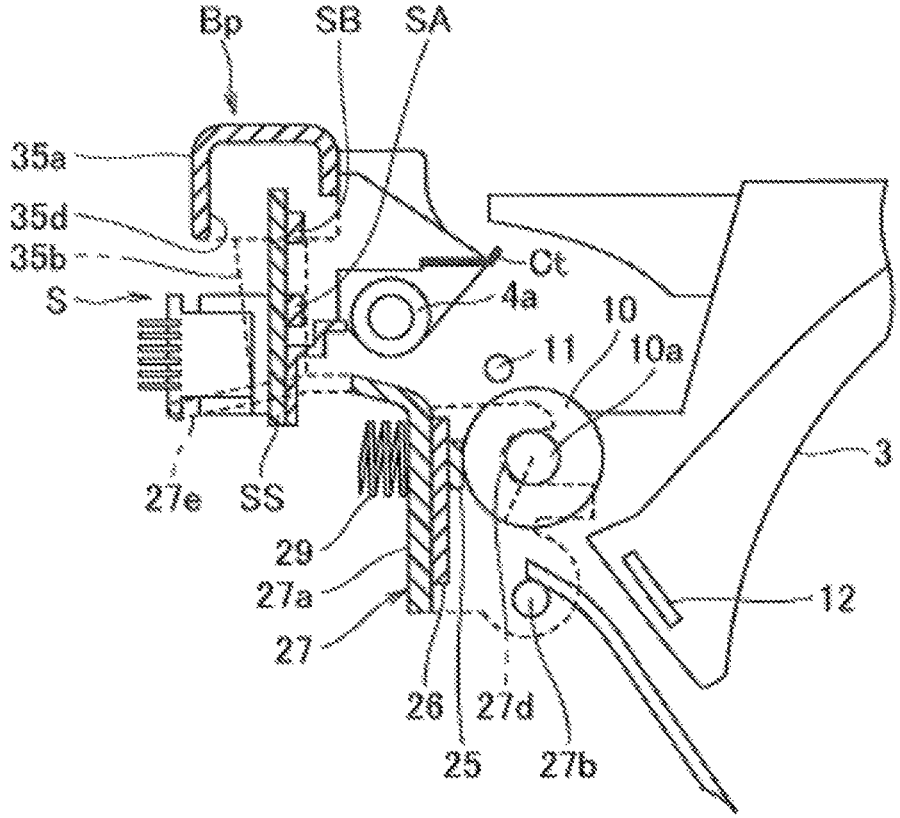
FIG. 8A is a cross-sectional view of a major part of the printer of FIG. 1A and FIG. 1B when the printer operates while opening the opening and closing cover.
Figure 8B:
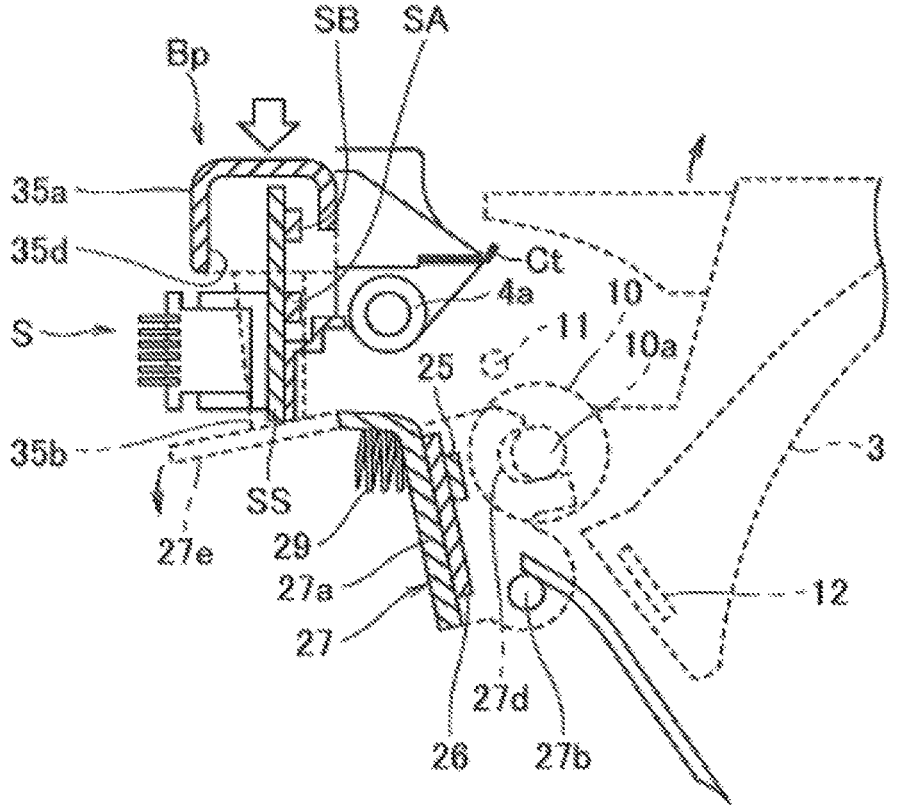
FIG. 8B is a cross-sectional view of a major part of the printer of FIG. 1A and FIG. 1B when the printer operates while opening the opening and closing cover.

The following describes the internal configuration of the printer 1, with reference to FIGS. 3A to 8B. FIG. 3A is a schematic cross-sectional view of the printer of FIG. 1A in the normal ejection state at a center in the width direction of the printer. FIG. 3B is a schematic cross-sectional view of the printer of FIG. 1A in the normal ejection state at one end in the width direction of the printer. FIG. 4A is a schematic cross-sectional view of the printer of FIG. 1B in the separation ejection state at a center in the width direction of the printer. FIG. 4B is a schematic cross-sectional view of the printer of FIG. 1B in the separation ejection state at one end in the width direction of the printer. FIG. 5 is a perspective view of a major part of the printer of FIG. 1A and FIG. 1B. FIG. 6 is a perspective view of a major part of the printer of FIG. 5 when a part of the printer including a separation unit is detached. FIG. 7A is a cross-sectional view taken along the line I-I of FIG. 5. FIG. 7B is a cross-sectional view taken along the line II-II of FIG. 6. FIGS. 8B and 8A are cross-sectional views of a major part of the printer of FIG. 1A and FIG. 1B when the printer operates while opening the opening and closing cover.

As shown in FIGS. 3A to 4B, the printer 1 includes the separation unit 4, a thermal head (one example of a print head) 25, a circuit board 26, a head bracket (one example of a head holding member) 27, a coil spring 29, a cutter (one example of a cutting unit) Ct, a sensor unit S and a cover-open button Bp. These components are opposed to the platen roller 10 in the printer 1.

As shown in FIGS. 3A to 5, the separation unit 4 is disposed so that the nip roller 4*a* can move across a position (ejection port) between the thermal head 25 and the platen roller 10 upstream of the cutter Ct in the feeding direction. That is, the nip roller 4*a* can move between a position close to the thermal head 25 (normal ejection position (one example of a first position), see FIGS. 3A and 3B) and a position close to the platen roller 10 (separation ejection position (one example of a second position), see FIGS. 4A and 4B). In the normal ejection mode, the nip roller 4*a* is stored at the back between the cutter Ct and the thermal head 25 as shown in FIGS. 3A and 3B. In the separation ejection mode, the nip roller 4*a* is opposed to the platen roller 10 as shown in FIGS. 4A and 4B. In this separation ejection mode, the platen roller 10 and the nip roller 4*a* pinch the liner PM of the continuous label P therebetween, and the platen roller 10 rotates. Then, the nip roller 4*a* rotates following the rotation of the platen roller 10. This separates the labels PL from the liner PM while feeding the liner PM.

The thermal head 25 is a print unit to print information such as letters, symbols, graphics or barcodes on the continuous label P. As shown in FIGS. 3A, 4A, and 7A, the thermal head 25 is mounted at a holding part 27*a* of the head bracket 27 via the circuit board 26 so that the print surface of the thermal head 25 faces the sheet-feeding path and the thermal head 25 is opposed to the platen roller 10 when the opening and closing cover 3 is closed. On the print surface of the thermal head 25, a plurality of heater resistors (heater elements) that generate heat when applying current are arranged along the width direction (direction of a shorter side) of the continuous label P. The circuit board 26 is a wiring board to receive print signals from a control unit (not illustrated) to control the overall operation of the printer 1 and transmit the print signals to the thermal head 25.

As shown in FIGS. 3A to 4B and 7A, the head bracket 27 is a member to hold the thermal head 25. The head bracket 27 is also configured to hold the opening and closing cover 3 or cancel the holding of the opening and closing cover 3. The head bracket 27 is opposed to the platen roller 10 when the opening and closing cover 3 is closed. The head bracket 27 is pivotally supported at a supporting shaft 27*b* swingably to move closer to and away from the platen roller 10 so as to hold the opening and closing cover 3 and cancel the holding of the opening and closing cover 3.

This head bracket 27 is made of metal, for example. The head bracket 27 functions to dissipate heat generated at the thermal head 25. With this configuration, as compared with the configuration including a separate heat sink to dissipate heat generated at the thermal head 25, the printer 1 can be made compact and light-weight. Also, as compared with the configuration including a separate heat sink, the number of components of the printer 1 can be reduced, and so the cost for producing the printer 1 can be reduced.

As shown in FIGS. 3B, 4B and 5 to 7A, the holding part 27*a* of the head bracket 27 has a pair of wings 27*c*, 27*c* at both ends of the platen roller 10 in the longitudinal direction. The pair of wings 27*c*, 27*c* are integrally formed with the holding part 27*a*. The pair of wings 27*c*, 27*c* extend toward the platen roll 10. Each of the wings 27*c*, 27*c* has a groove 27*d* at the leading end. Both ends of the platen shaft 10*a* in the longitudinal direction fit in these grooves 27*d*, whereby the head bracket 27 can hold the opening and closing cover 3 while leaving the platen roller 10 rotatable.

As shown in FIGS. 3B, 4B, 6 and 7B, the head bracket 27 has a pair of pressed parts 27*e* integrally formed with the holding part 27*a* and on the upper side of the holding part 27*a*. These pressed parts 27*e* are placed in the vicinity of a center of the platen roller 10 in the longitudinal direction. The pressed parts 27*e* extend in the direction away from the platen roller 10. As shown in FIGS. 6 and 7B, this pair of pressed parts 27*e* extends from the holding part 27*a* so as to sandwich a circuit board SS of a sensor unit S at its both lateral faces in the width direction. As shown in FIGS. 3B and 4B, the pressed parts 27*e* terminate in a floating manner at the extending ends.

As shown in FIGS. 3A to 4B and 7A, the coil spring 29 is a member to bias the thermal head 25 and the head bracket 27 toward the platen roller 10 when the opening and closing cover 3 is closed. The coil spring 29 is disposed on the rear face of the head bracket 27 (on the rear face of the circuit-mounting face of the circuit board 26). Biasing force of this coil spring 29 presses the head bracket 27 toward the platen roller 10, and this can press the thermal head 25 against the platen 10 firmly via the continuous label P. This also can press the platen shaft 10*a* fitted into the grooves 27*d* of the head bracket 27 firmly, and the head bracket 27 can hold the opening and closing cover 3 firmly.

As shown in FIGS. 3A to 4B and 7A, the cutter Ct is a fixed blade to cut the continuous label P after printing. The cutter Ct is fixed to the leading end of a supporting part 31 so that its blade edge faces the sheet-feeding path of the continuous label P. The cutter Ct extends along the longitudinal direction (direction perpendicular to the sheet of FIGS. 3A to 4B and 7A) of the platen roller 10. The supporting part 31 configured to support this cutter Ct has an inclined face so that its thickness reduces gradually from the side close to the cover-open button Bp to the side close to the platen roller 10. The blade edge of the cutter Ct is disposed at a position (height) closer to the thermal head 25 than to the surface of the front cover 2*b*. Such an inclined surface of the supporting part 31 widens the region of the label PL which a user picks up with fingers in the separation ejection mode, and so a user can easily pick up the label PL. The supporting part 31 does not interfere with the cutting of the continuous label P, and so the user can cut the continuous label P well. Since the blade edge of the cutter Ct is disposed close to the thermal head 25, the distance to feed the continuous label P decreases during feeding and back feeding. This can shorten the time to prepare the print operation of the printer 1. The cutter Ct is disposed inside of the surface of the front cover 2*b*. This can avoid the finger of the operator touching the cutter Ct, and so the safety of the printer 1 can be improved.

As shown in FIGS. 3A, 4A and 5 to 7B, the sensor unit S is a detector of the continuous label P after printing. The sensor unit includes a separation sensor (one example of a first detector) SA, a sheet detection sensor (one example of a second detector) SB, a circuit board SS, a connector SC and wiring SW.

As shown in FIGS. 3A, 4A, 7A and 7B, the separation sensor SA is configured to detect the nip roller 4*a* of the separation unit 4 so as to know whether the ejection mode of the printer is normal ejection or separation ejection. The separation sensor SA also detects a label PL after printing separated from the liner PM when a label with a liner is used as the continuous label P. The separation sensor SA is disposed between the cutter Ct and the platen roller 10 so as to face the sheet-feeding path of the continuous label P. The separation sensor SA includes a reflective optical sensor, for example, and includes a light-emission part SA1 and a light-receiving part SA2 as shown in FIGS. 5, 6, and 7B. The light-emission part SA1 and the light-receiving part SA2 are disposed on the principal face of the circuit board SS side by side along the width direction of the circuit board SS (longitudinal direction of the platen roller 10, horizontal direction of FIG. 7B). The supporting part 31 has a through hole (not illustrated) to transmit detection light of the separation sensor SA (emitted light and reflected light).

As shown in FIGS. 3A, 4A and 7A, the sheet detection sensor SB is configured to detect the presence or absence of the continuous label P after cutting when the printer ejects the continuous label P without separating the labels (this applies to both of a label with a liner and linerless label). The sheet detection sensor SB includes a reflective optical sensor, for example, and includes a light-emission part SB1 and a light-receiving part SB2 as shown in FIG. 6, and 7B. The light-emission part SB1 and the light-receiving part SB2 are disposed on the principal face of the circuit board SS side by side along the width direction of the circuit board SS (longitudinal direction of the platen roller 10, horizontal direction of FIG. 7B). The supporting part 31 has a through hole (not illustrated) to transmit detection light of the sheet detection sensor SB (emitted light and reflected light).

The sheet detection sensor SB is disposed downstream of the cutter Ct in the feeding direction, and between the cutter Ct and the surface of the front cover 2*b* (above the separation sensor SA in FIGS. 3A and 4A). The sheet detection sensor B faces the sheet-feeding path of the continuous label P. That is, the separation sensor SA and the sheet detection sensor SB are disposed in two stages along the feeding direction. If the cutter Ct is placed at the surface of the front cover 2*b*, the sheet detection sensor SB will be disposed on the surface of the front cover 2*b*. This increases the printer 1 in thickness and size. On the contrary, since the cutter Ct of the present embodiment is disposed inside of the surface of the front cover 2*b* and the sheet detection sensor SB is disposed between the surface of the front cover 2*b* and the cutter Ct, the printer 1 can be compact.

As shown in FIGS. 3A, 4A, 7A and 7B, the circuit board SS is one example of a common circuit board to mount the separation sensor SA and the sheet detection sensor SB. The circuit board SS is disposed (fixed) vertically along the feeding direction of the continuous label P within the region to dispose the cover-open button Bp. If the cutter Ct was located at the surface of the front cover 2*b*, the sheet detection sensor SB would be disposed on the surface of the front cover 2*b*. This means a too long distance between the separation sensor SA and the sheet detection sensor SB, and it would be difficult to dispose these sensors on a common circuit board SS. On the contrary, since the cutter Ct of the present embodiment is disposed inside of the surface of the front cover 2*b* and the sheet detection sensor SB is disposed between the surface of the front cover 2*b* and the cutter Ct, the distance between the separation sensor SA and the sheet detection sensor SB can be shortened. It is therefore easy to dispose the sensors on a common circuit board SS.

The circuit board SS includes a print circuit board, for example. The circuit board SS has a rear face (the rear face of the sensor-mounting face for the separation sensor SA and the sheet detection sensor SB), on which the connector SC and the wiring SW are electrically connected. The separation sensor SA and the sheet detection sensor SB are electrically connected to the control unit via the circuit board SS, the connector SC and the wiring SW.

In this way, the separation sensor SA and the sheet detection sensor SB are mounted on the common circuit board SS, and so the wiring pattern in the circuit board SS and the connector SC can be common to these sensors. As compared with the case including different circuit boards on which the separation sensor SA and the sheet detection sensor SB are disposed, the area of the circuit board can be reduced. The wiring SW to electrically connect the separation sensor SA and the sheet detection sensor SB to the control unit can be tied together, and so the spatially occupied area of the wiring SW can be reduced. This can make the printer 1 compact. Since the area of the circuit board SS can be reduced, the number of the circuit boards SS obtained from one base board can be increased. The usage amount of metal materials for wiring also can be reduced, and so the cost for producing the circuit board SS can be reduced. A common connector SC can be used, and the cost of the connector SC also can be reduced. Therefore the whole cost of the printer 1 can be reduced.

As shown in FIGS. 6 and 7B, a protruding step (one example of a protrusion) Pj is disposed between the front face (the face opposed to the platen roller 10) of a cover that covers the circuit board SS of the sensor unit S and the head bracket 27. The protruding step Pj protrudes from the front face of the sensor unit S toward the platen roller 10. This protruding step Pj is made of plastic, for example, having lower light reflectance than that of metals.

As described above, the head bracket 27 has a function to dissipate heat from the thermal head 25, and so the head bracket desirably has a largest possible area. From this viewpoint, the head bracket 27 is preferably formed to a position close to the front face of the sensor unit S. Such a configuration, however, may lead to malfunction of the separation sensor SA and the sheet detection sensor SB because the head bracket 27 is made of metals from which light emitted from the light-emitting parts SA1 and SB1 of the separation sensor SA and the sheet detection sensor SB may be reflected, and such light may enter the light-receiving parts SA2 and SB1 of the separation sensor SA and the sheet detection sensor SB.

On the contrary, in the present embodiment, the protruding step Pj lies between the front face of the sensor unit S and the head bracket 27. This can suppress or prevent the light reflected the metal head bracket 27 from entering the light-receiving parts SA2 and SB2 of the separation sensor SA and the sheet detection sensor SB. Therefore malfunction of the separation sensor SA and the sheet detection sensor SB can be prevented.

As shown in FIGS. 3A to 8B, the cover-open button Bp is configured to open the opening and closing cover 3. The cover-open button Bp is disposed movably in the direction (the vertical direction in FIGS. 7A and 7B) intersecting with the surface of the front cover 2*b*. The cover-open button Bp is opposed to the pair of pressed parts 27*e* of the head bracket 27 (opposed to one lateral face of the circuit board SS vertically disposed). The cover-open button Bp is made up of integrally-formed parts, including a pressing part 35*a*, a pair of legs 35*b* and a pair of leaf springs 35*c*.

When opening the opening and closing cover 3, the operator presses the pressing part 35*a* of the cover-open button Bp. As shown in FIGS. 3A, 4A, and 7A to 8B, the pressing part 35*a* has a concave 35*d* depressed in the direction away from the circuit board SS at a part opposed to the circuit board SS of the sensor unit S. That is, the rear face of the cover-open button Bp and the upper end of the circuit board SS have a predetermined distance therebetween when the opening and closing cover 3 is closed. Therefore as shown in FIG. 8B, the pressing part 35*a* does not come in contact with the circuit board SS when the operator presses the cover-open button Bp to open the opening and closing cover 3.

As shown in FIGS. 5, 6 and 7B, the pair of legs 35*b* of the cover-open button Bp extends from the rear face at both ends in the longitudinal direction of the pressing part 35*a*. The pair of legs 35*b* extends from there toward the pair of pressed parts 27*e* of the head bracket 27 while sandwiching both of the lateral faces of the circuit board SS in the width direction to come in contact with the pair of the pressed parts 27*e*. In this way, the circuit board SS of the sensor unit S is disposed at a blank area surrounded with the pressing part 35*a* and the pair of legs 35*b* of the cover-open button Bp. That is, such a blank area of the printer 1 can be effectively used, and so the printer 1 can be made compact as compared with the configuration including the sensor unit S at other places.

When opening the opening and closing cover 3, the operator presses the pressing part 35*a* of the cover-open button Bp inwardly of the printer 1 from the state of FIG. 8A as shown in FIG. 8B. Then, the pair of pressed parts 27*e* of the head bracket 27 also is pressed via the pair of legs 35*b*. At this time, a part of the circuit board SS opposed to the pressing part 35*a* enters the concave 35*d* on the side of the rear face of the pressing part 35*a*, and such a part does not come in contact with the rear face of the pressing part 35*a*. When the pair of pressed parts 27*e* of the head bracket 27 is pressed, the head bracket 27 swings about the supporting shaft 27*b* in the direction away from the platen roller 10. As a result, the platen shaft 10*a* of the platen roller 10 leaves from the grooves 27*d* at the leading ends of the pair of wings 27*c*, 27*c* of the head bracket 27, and so the holding of the opening and closing cover 3 by the head bracket 27 is cancelled. When the holding of the opening and closing cover 3 is cancelled in this way, the opening and closing cover 3 will open automatically by the biasing force of the torsional spring 3*b* disposed at the opening and closing supporting shaft 3*a*(see FIGS. 3A to 4B) at the other end in the longitudinal direction of the opening and closing cover.

As shown in FIGS. 5, 6 and 7B, the pair of leaf springs 35*c* of the cover-open button Bp extends downward (in the direction of the pressed parts 27*e*) from the periphery of both lateral faces in the longitudinal direction of the pressing part 35*a*. As shown in FIG. 7B, this pair of leaf springs 35*c* engages with a part of the inner lateral face of a through hole 36 bored at the front cover 2*b*. With this configuration, the cover-open button Bp is biased toward the head bracket 27 by the action of the pair of leaf springs 35*c* when the opening and closing cover 3 is closed, and so the pair of legs 35*b* of the cover-open button Bp is lightly pressed against the pair of pressed parts 27*e* of the head bracket 27. This can suppress the motion of the cover-open button Bp, and so can prevent the rattling of the cover-open button Bp. When the opening and closing cover 3 is opened, the pair of pressed parts 27*e* of the head bracket 27 is biased toward the cover-open button Bp by the action of the coil spring 29. At this time, the pair of leaf springs 35*c* on the both lateral faces in the longitudinal direction of the cover-open button Bp deflects toward the center in the longitudinal direction of the cover-open button Bp. As a result, the cover-open button Bp also rises. That is, the pair of pressed parts 27*e* of the head bracket 27 allows the cover-open button Bp to rise.

Figure 9:
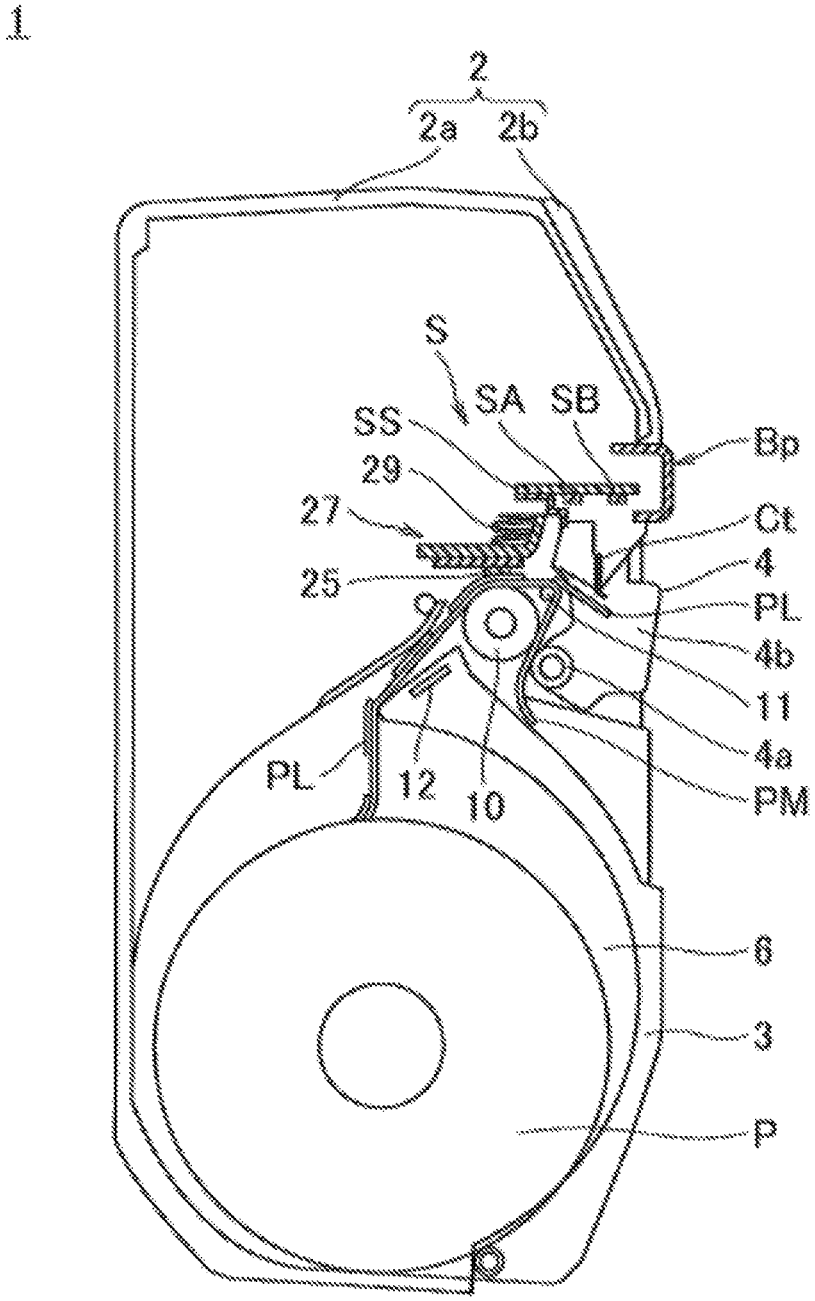
FIG. 9 schematically shows the printer of FIG. 1A and FIG. 1B in the separation ejection, viewed from a lateral face of the printer.
Figure 10:
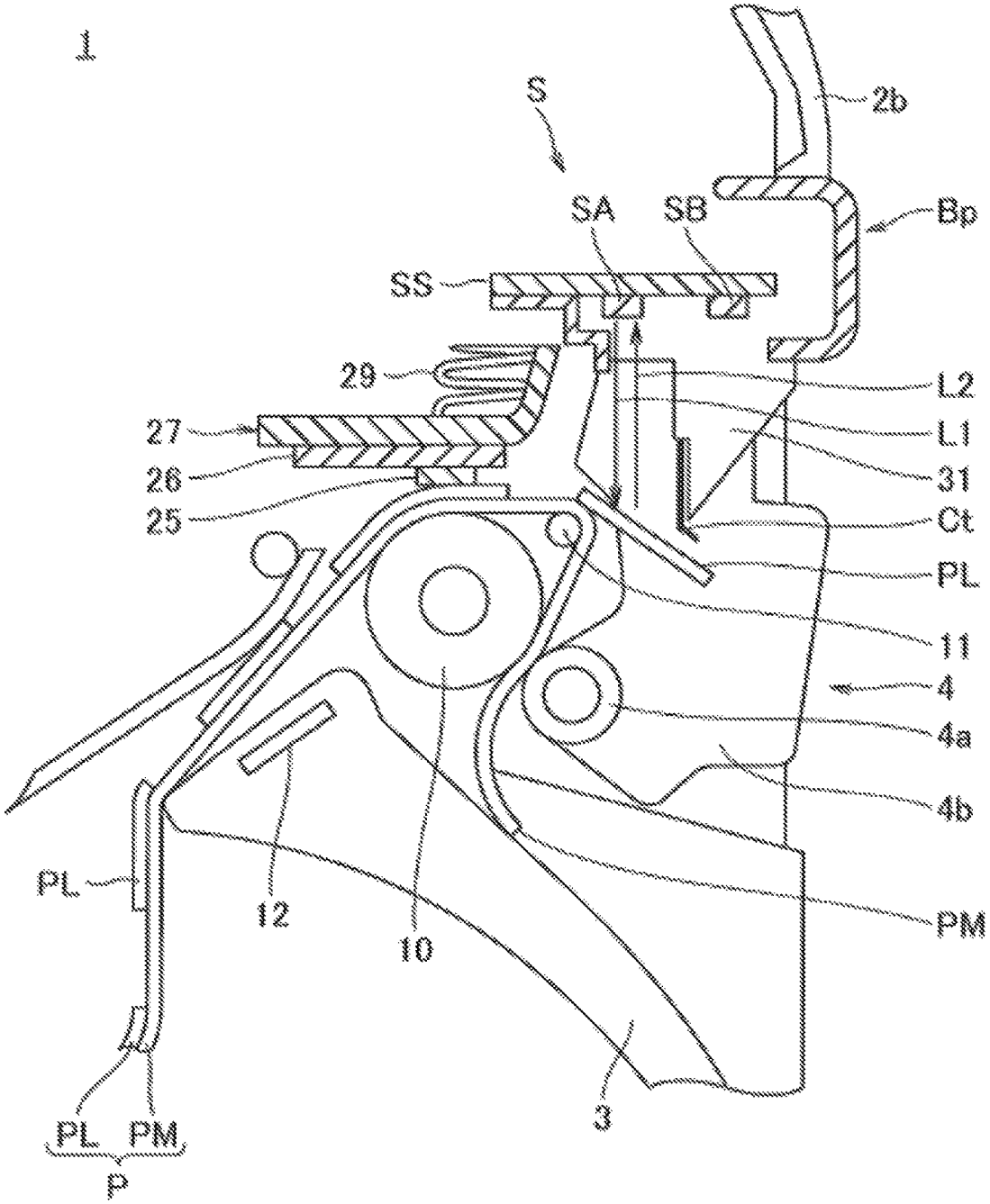
FIG. 10 is a schematic enlarged view of a major part of the printer of FIG. 9.
Figure 11:
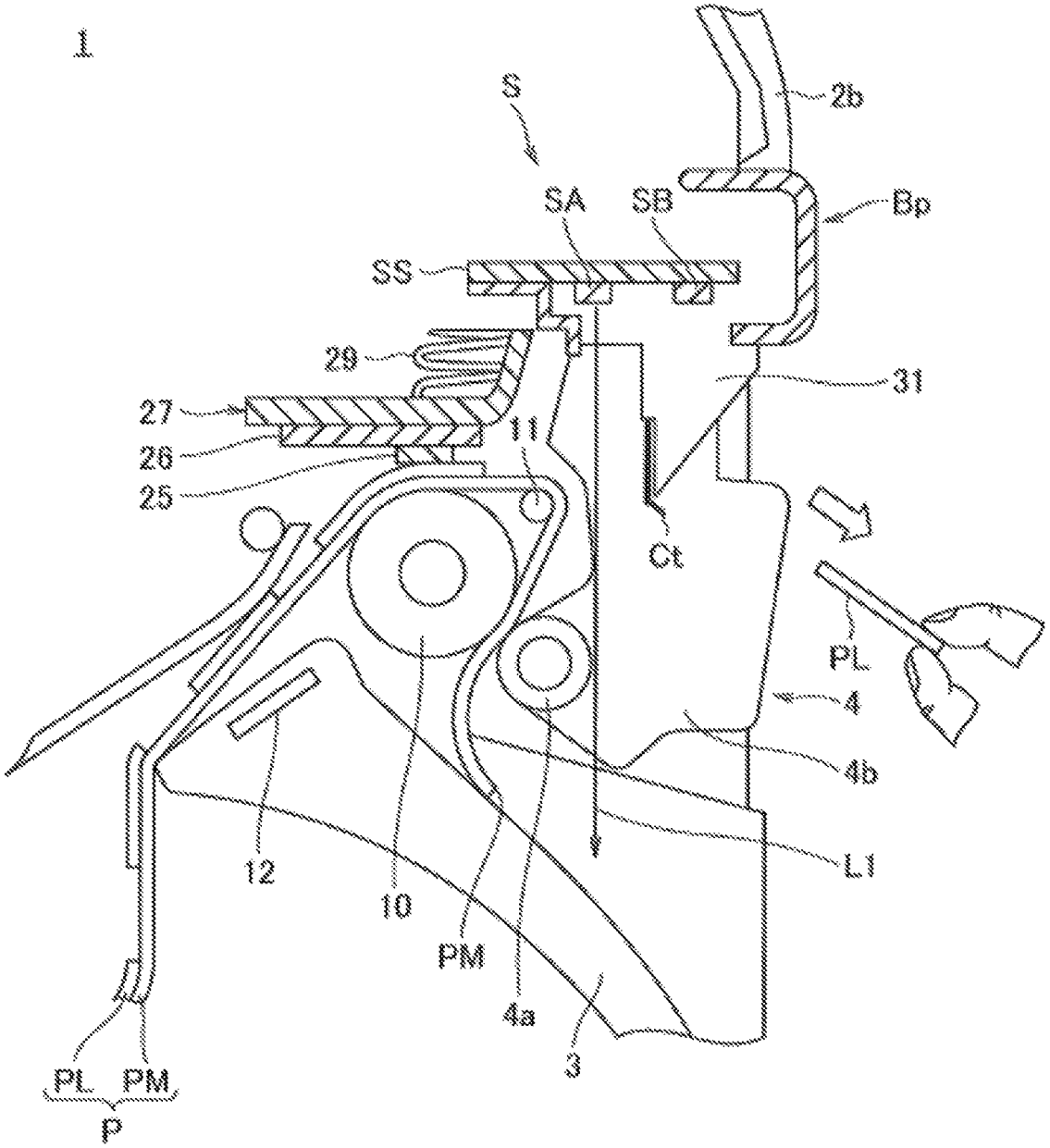
FIG. 11 schematically shows the printer in the separation ejection following FIG. 10, viewed from a lateral face of the printer.

The following describes one example of the separation ejection of the printer 1, with reference to FIGS. 9 to 11. FIG. 9 schematically shows the printer of FIG. 1A and FIG. 1B in the separation ejection, viewed from a lateral face of the printer. FIG. 10 is a schematic enlarged view of a major part of the printer of FIG. 9. FIG. 11 schematically shows the printer in the separation ejection following FIG. 10, viewed from a lateral face of the printer. FIGS. 9 to 11 illustrate the printer 1 in the vertical use.

Firstly as shown in FIG. 9, the continuous label P released from the sheet container 6 is pulled outside from between the thermal head 25 and the platen roller 10. Then, one end in the longitudinal direction of the liner PM of the continuous label P is bent at a sharp angle via the separation pin 11, and is pinched between the nip roller 4*a* of the separation unit 4 that is pulled from the inside and the platen roller 10. At this stage, when the separation sensor SA emits detection light from the light-emitting part SA1, the light-receiving part SA2 of the separation sensor SA does not detect light reflected from the nip roller 4*a* because the nip roller 4*a* of the separation unit 4 is not present at the place. Therefore the printer 1 determines that the ejection mode is the separation ejection mode.

Next, while the platen roller 10 rotates to feed the continuous label P, print timing is found based on the information detected by the sensors 12. The heater resistors of the thermal head 25 generate heat selectively in accordance with the print signals transmitted to the thermal head 25, whereby desired information is printed on the label PL of the continuous label P. At this time, as shown in FIG. 10, the nip roller 4*a* also rotates following the rotation of the platen roller 10 to feed the liner PM. Meanwhile, since the direction of feeding for the label PL is steeply curved at the separation pin 11 from the direction of feeding the liner PM, the label PL is separated from the liner PM due to the strength of the label PL. The separated label PL is ejected from the ejection port. At this stage, the separation sensor SA emits detection light L1 from the light-emitting part SA1. Then the detection light L1 is reflected from the label PL, and the reflected light is incident as detection light L2 on the light-receiving part SA2 of the separation sensor SA. Then the separation sensor SA determines that the label P is present at the ejection port of the printer 1. Note that although the detection light L1 and L2 are shown horizontally side by side for the purpose of illustration, the detection light L1 and L2 actually are in the direction perpendicular to the sheet of FIG. 10.

Next as shown in FIG. 11, the operator pinches the protruding part of the label PL ejected from the ejection port of the printer 1 using fingers and pulls the label PL using the fingers to separate it from the liner PM completely. At the stage after this operation, when the separation sensor SA emits detection light L1 from the light-emitting part SA1, the detection light L1 is not reflected because the label PL is no longer present there (i.e., the light-receiving part SA2 does not detect detection light L2). Then the separation sensor SA determines that no label P is present at the ejection port of the printer 1. Then after the back feeding step, the printer 1 shifts to the printing step of a subsequent label PL.

Figure 12:
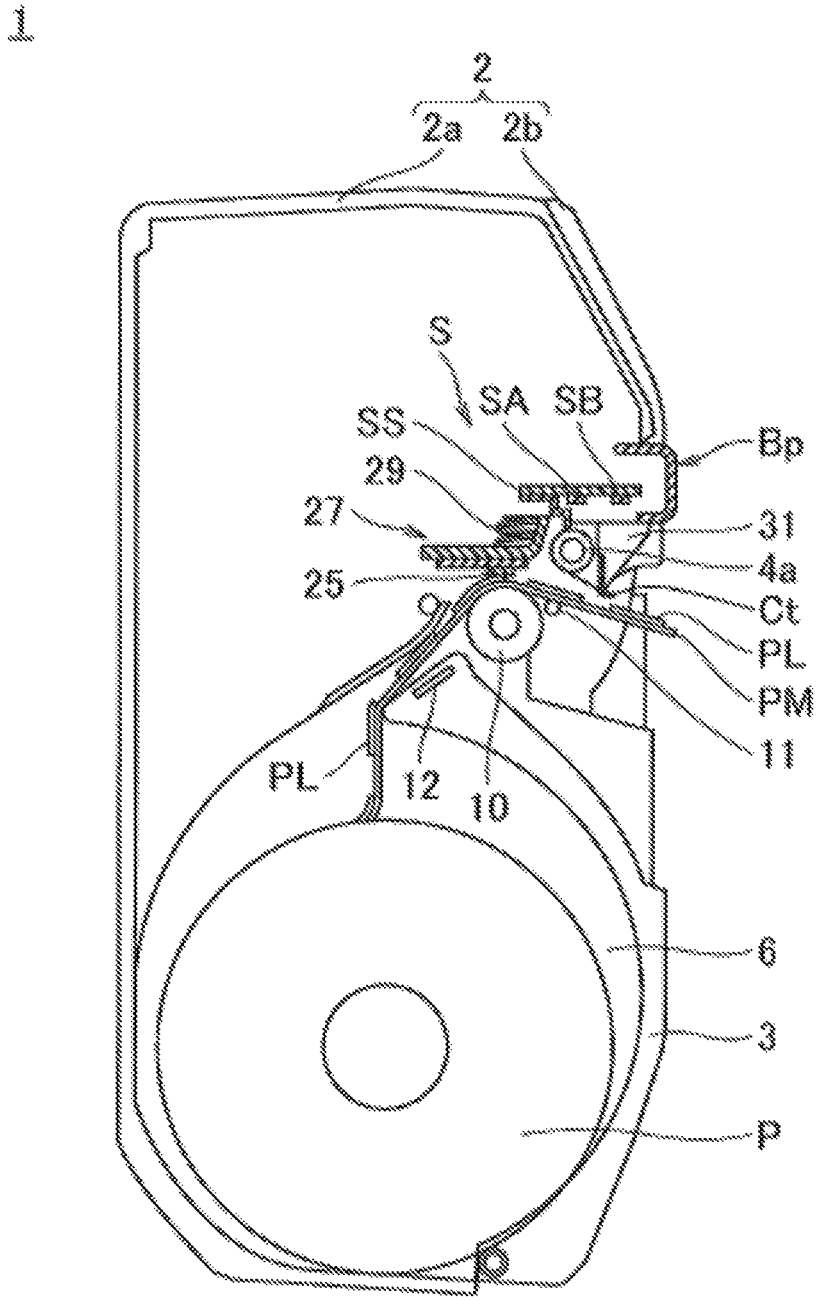
FIG. 12 schematically shows the printer of FIG. 1A and FIG. 1B in the normal ejection, viewed from a lateral face of the printer.
Figure 13:
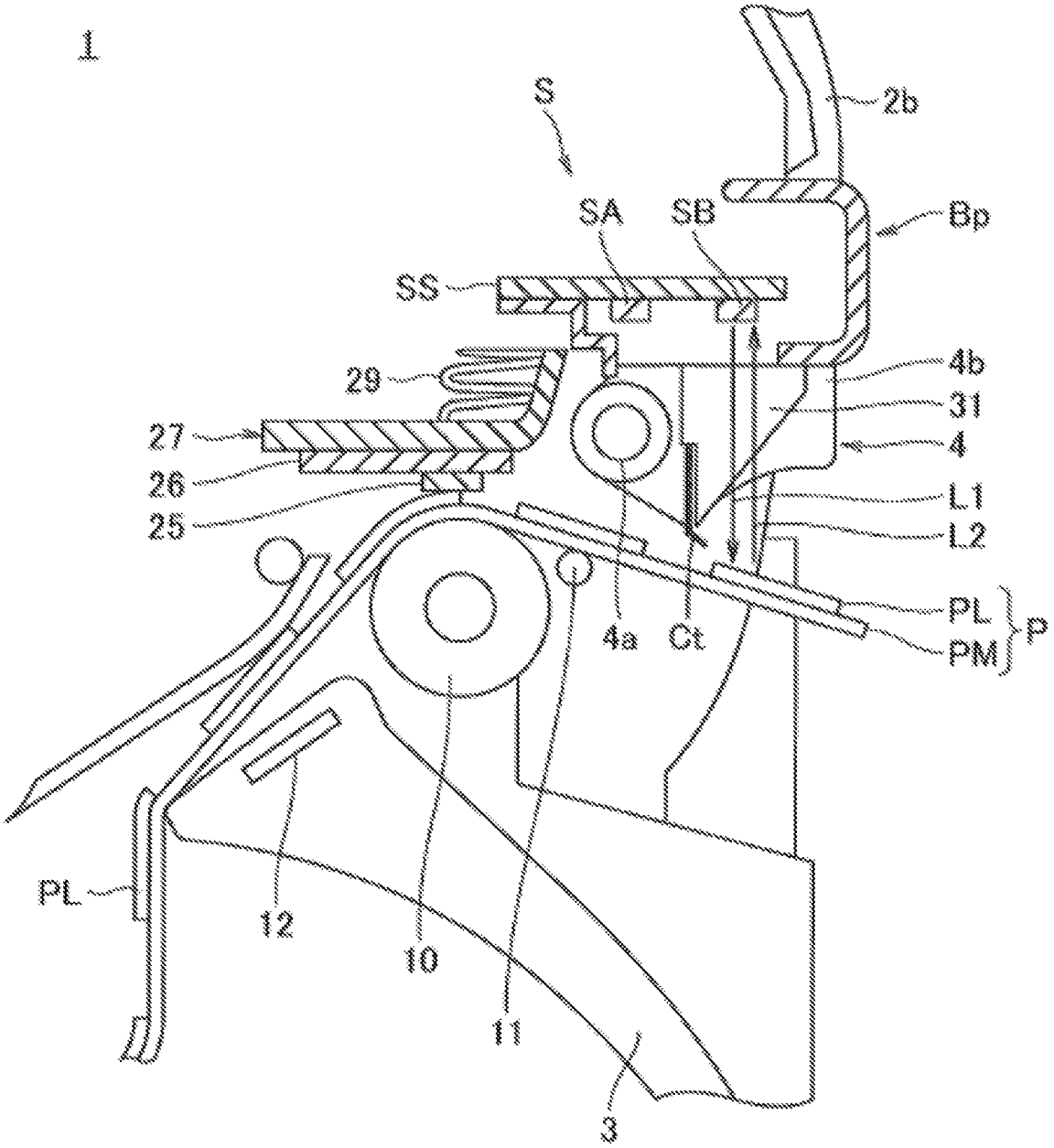
FIG. 13 is a schematic enlarged view of a major part of the printer of FIG. 12.
Figure 14:
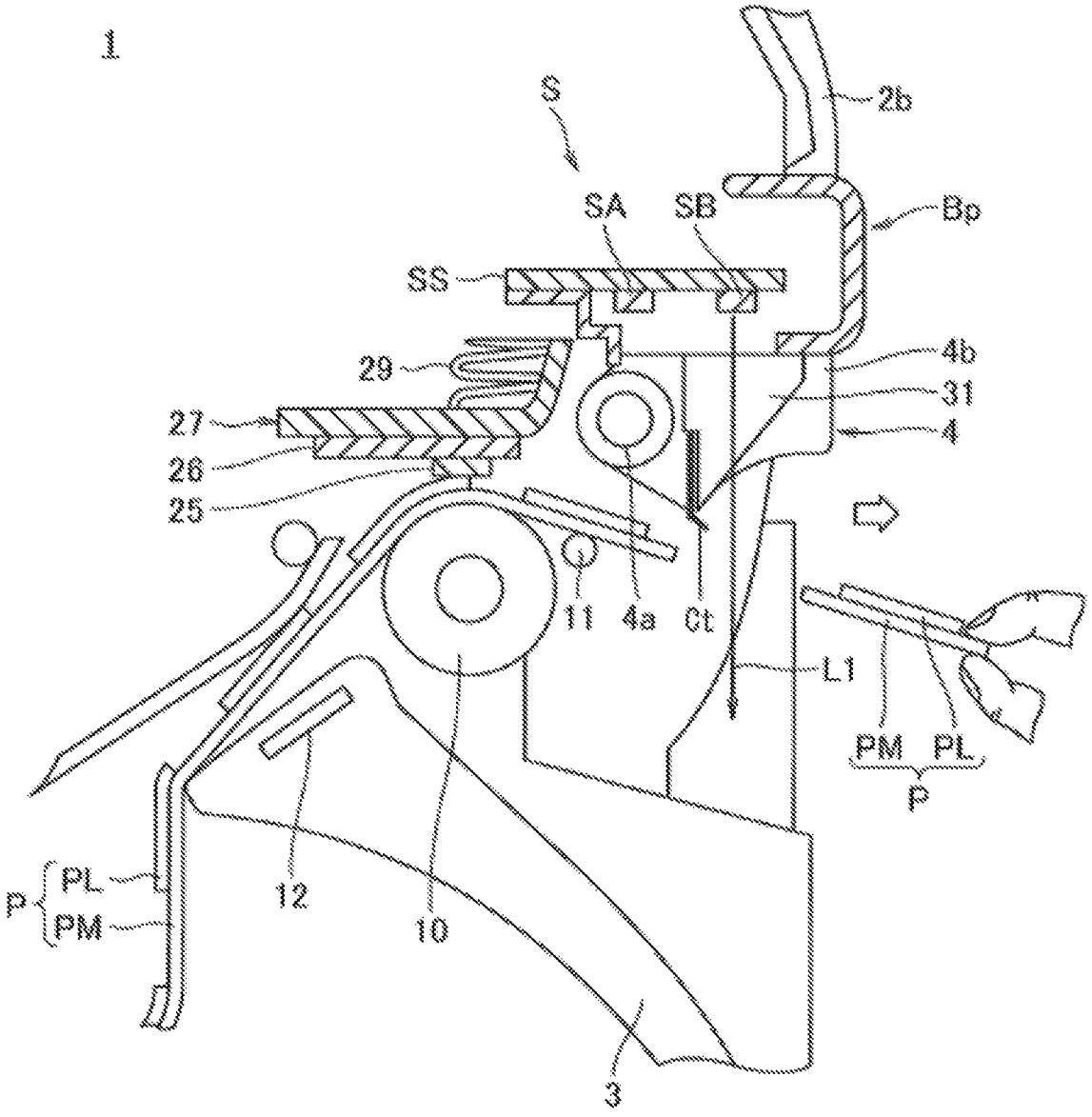
FIG. 14 schematically shows the printer in the normal ejection following FIG. 13, viewed from a lateral face of the printer.

The following describes one example of the normal ejection of the printer 1, with reference to FIGS. 12 to 14. FIG. 12 schematically shows the printer of FIG. 1A and FIG. 1B in the normal ejection, viewed from a lateral face of the printer. FIG. 13 is a schematic enlarged view of a major part of the printer of FIG. 12. FIG. 14 schematically shows the printer in the normal ejection following FIG. 13, viewed from a lateral face of the printer. FIGS. 12 to 14 also illustrate the printer 1 in the vertical use.

Firstly as shown in FIG. 12, the continuous label P released from the sheet container 6 is pulled outside from between the thermal head 25 and the platen roller 10. In this case, the separation unit 4 is stored inside of the printer 1. At this stage, the amount of reflected light of the light emitted from the light-emitting part SA1 of the separation sensor SA decreases due to the nip roller 4*a* of the separation unit 4. Therefore the amount of light received by the light-receiving part SA2 of the separation sensor SA also decreases. As a result, the separation sensor SA determines that the ejection mode is the normal ejection mode. Since a label with a liner is used as the continuous label P, the operator manipulates the operation buttons Bc to manually select the continuous ejection mode of the normal ejection mode. When a linerless label without a liner fed while exposing the adhesive layer on one side is used, the operator manipulates the operation buttons Bc to manually select the linerless label ejection mode.

Next, while the platen roller 10 rotates to feed the continuous label P, print timing is found based on the information detected by the sensors 12. The heater resistors of the thermal head 25 generate heat selectively in accordance with the print signals transmitted to the thermal head 25, whereby desired information is printed on the label PL of the continuous label P. In the normal ejection, the label PL after printing is not separated from the liner PM. The lebal PL adhering to the liner PM is ejected.

In the normal ejection, since the nip roller 4*a* of the separation unit 4 is present in front of the separation sensor SA, the separation sensor SA cannot detect the label. Then, the sheet detection sensor SB detects the label in this case. That is, as shown in FIG. 13, the sheet detection sensor SB emits detection light L1 from the light-emitting part SB1. Then the detection light L1 is reflected from the continuous label P, and the reflected light is incident as detection light L2 on the light-receiving part SB2 of the sheet detection sensor SB. Then the sheet detection sensor SB determines that the continuous label P is present at the ejection port of the printer 1.

Next as shown in FIG. 14, the operator pinches the continuous label P ejected from the ejection port of the printer 1 using fingers and presses a part of the liner PM of the continuous label P against the cutter Ct to cut the continuous label P. At the stage after this operation, when the sheet detection sensor SB emits detection light L1 from the light-emitting part SB1, the detection light L1 is not reflected because the continuous label P is no longer present there (that is, the light-receiving part SB2 does not detect the detection light L2). Then the sheet detection sensor SB determines that no continuous label P is present at the ejection port of the printer 1. Then after the back feeding step, the printer 1 shifts to the printing step of a subsequent label PL. For the purpose of illustration, the drawings illustrate the case of cutting the liner PM with the length of one label PL. Actually however, the liner PM is cut after printing on a plurality of labels PL successively. When a label without a liner is used as the continuous label P, the printer feeds the label while exposing an adhesive layer of the label on one side. In this case, the printer prints while storing the separation unit 4 inside of the printer 1, but the continuous label P is cut for each of the labels similarly to the separation ejection (linerless label ejection mode).

Although the specific descriptions of the invention by the present inventor have been provided by way of the embodiment, the embodiment disclosed in the specification is illustrative in all aspects and the invention should not be limited to the disclosed techniques. That is, the technical scope of the present invention should not be construed limitedly based on the descriptions on the above embodiments, but should be construed in accordance with the definitions of the claims. The present invention should cover equivalent and all modifications thereof without departing from the scope of claims.

The invention claimed is:

1. A printer, comprising:

a housing configured to store a print medium;

an opening and closing cover supported by the housing so as to be opened and closed;

a feed roller disposed at the opening and closing cover, the feed roller being configured to feed the print medium;

a print head disposed to be opposed to the feed roller in the housing, the print head being configured to print on the print medium;

a cutting unit disposed to be opposed to the feed roller, the cutting unit being disposed downstream of the feed roller in a feeding direction, the cutting unit being configured to cut the print medium after printing by the print head;

a first detector disposed between the print head and the cutting unit, the first detector being configured to detect the print medium after printing;

a second detector disposed downstream of the cutting unit in the feeding direction, the second detector being configured to detect the print medium after printing; and a circuit board common to the first detector and the second detector, the circuit board being configured to mount both of the first detector and the second detector.

2. The printer according to claim 1, further comprising a separation unit disposed movably between a first position and a second position, the separation unit being opposed to the first detector at the first position between the print head and the cutting unit, the separation unit being closer to the feed roller at the second position than at the first position, wherein when a label with a liner including a label temporarily adhering to the liner is used as the print medium, the separation unit is placed at the second position to separate the label after printing from the liner.

3. The printer according to claim 1, wherein when a label with a liner including a label temporarily adhering to the liner is used as the print medium, the first detector detects the label after printing and separated from the liner, and when the label with a liner or a linerless label without the liner is used as the print medium, the second detector detects the print medium after printing.

4. The printer according to claim 1, further comprising:

a head holding member disposed swingably in the housing to hold the opening and closing cover and cancel holding of the opening and closing cover, the head holding member being configured to hold the print head; and a cancelling member configured to apply a pressing force to the head holding member to cancel holding of the opening and closing cover, wherein the circuit board is disposed vertically along the feeding direction in a range of a region where the cancelling member is disposed so that the first detector and the second detector face a feed path of the print medium and that the first detector and the second detector are disposed side by side along the feeding direction.

5. The printer according to claim 4, wherein the head holding member includes:

a holding part configured to hold the print head; and a pair of pressed parts extending from the holding part in a direction away from the feed roller, the pressed parts sandwiching both lateral faces of the circuit board in a direction of the width of the circuit board intersecting with the feeding direction, the pair of pressed parts receiving a pressing force from the cancelling member when holding of the opening and closing cover is cancelled, the cancelling member includes:

a pressing part opposed to one lateral face of the circuit board vertically disposed; and a pair of legs extending from the pressing part to come in contact with the pair of pressed parts of the head holding member, the pair of legs sandwiching both lateral faces of the circuit board in the direction of the width of the circuit board.

6. The printer according to claim 5, wherein the pressing part of the cancelling member has a concave depressed in a direction away from the circuit board at a part of the pressing part opposed to the circuit board.

7. The printer according to claim 5, further comprising a protrusion between the first detector and the print head, the protrusion protruding from a position closer to the first detector toward the feed roller.

8. The printer according to claim 5, wherein the circuit board is disposed at a blank area surrounded with the pressing part and the pair of legs of the cancelling member.

9. The printer according to claim 2, wherein when a label with a liner including a label temporarily adhering to the liner is used as the print medium, the first detector detects the label after printing and separated from the liner, and when the label with a liner or a linerless label without the liner is used as the print medium, the second detector detects the print medium after printing.

10. The printer according to claim 2, further comprising:

a head holding member disposed swingably in the housing to hold the opening and closing cover and cancel holding of the opening and closing cover, the head holding member being configured to hold the print head; and a cancelling member configured to apply a pressing force to the head holding member to cancel holding of the opening and closing cover, wherein the circuit board is disposed vertically along the feeding direction in a range of a region where the cancelling member is disposed so that the first detector and the second detector face a feed path of the print medium and that the first detector and the second detector are disposed side by side along the feeding direction.

11. The printer according to claim 3, further comprising:

a head holding member disposed swingably in the housing to hold the opening and closing cover and cancel holding of the opening and closing cover, the head holding member being configured to hold the print head; and a cancelling member configured to apply a pressing force to the head holding member to cancel holding of the opening and closing cover, wherein the circuit board is disposed vertically along the feeding direction in a range of a region where the cancelling member is disposed so that the first detector and the second detector face a feed path of the print medium and that the first detector and the second detector are disposed side by side along the feeding direction.

12. The printer according to claim 10, wherein the head holding member includes:

a holding part configured to hold the print head; and a pair of pressed parts extending from the holding part in a direction away from the feed roller, the pressed parts sandwiching both lateral faces of the circuit board in a direction of the width of the circuit board intersecting with the feeding direction, the pair of pressed parts receiving a pressing force from the cancelling member when holding of the opening and closing cover is cancelled, the cancelling member includes:

a pressing part opposed to one lateral face of the circuit board vertically disposed; and a pair of legs extending from the pressing part to come in contact with the pair of pressed parts of the head holding member, the pair of legs sandwiching both lateral faces of the circuit board in the direction of the width of the circuit board.

13. The printer according to claim 11, wherein the head holding member includes:

a holding part configured to hold the print head; and a pair of pressed parts extending from the holding part in a direction away from the feed roller, the pressed parts sandwiching both lateral faces of the circuit board in a direction of the width of the circuit board intersecting with the feeding direction, the pair of pressed parts receiving a pressing force from the cancelling member when holding of the opening and closing cover is cancelled, the cancelling member includes:

a pressing part opposed to one lateral face of the circuit board vertically disposed; and a pair of legs extending from the pressing part to come in contact with the pair of pressed parts of the head holding member, the pair of legs sandwiching both lateral faces of the circuit board in the direction of the width of the circuit board.

14. The printer according to claim 12, wherein the pressing part of the cancelling member has a concave depressed in a direction away from the circuit board at a part of the pressing part opposed to the circuit board.

15. The printer according to claim 13, wherein the pressing part of the cancelling member has a concave depressed in a direction away from the circuit board at a part of the pressing part opposed to the circuit board.

16. The printer according to claim 12, further comprising a protrusion between the first detector and the print head, the protrusion protruding from a position closer to the first detector toward the feed roller.

17. The printer according to claim 13, further comprising a protrusion between the first detector and the print head, the protrusion protruding from a position closer to the first detector toward the feed roller.

18. The printer according to claim 14, further comprising a protrusion between the first detector and the print head, the protrusion protruding from a position closer to the first detector toward the feed roller.

* * * * *